US005729096A

United States Patent [19]

Liu et al.

[11] Patent Number: 5,729,096

[45] Date of Patent: Mar. 17, 1998

[54] INVERTER PROTECTION METHOD AND PROTECTION CIRCUIT FOR FLUORESCENT LAMP PREHEAT BALLASTS

[75] Inventors: Guang Liu, Lake Zurich; Anand K. Upadhyay, Libertyville, both of Ill.

[73] Assignee: Motorola Inc., Schaumburg, Ill.

[21] Appl. No.: 686,639

[22] Filed: Jul. 24, 1996

[51] Int. Cl.[6] ..... H05B 37/02

[52] U.S. Cl. ..... 315/225; 315/DIG. 7; 315/307; 315/209 R

[58] Field of Search ..... 315/225, 209 R, 315/DIG. 7, DIG. 4, 307, 291, 308

[56] References Cited

U.S. PATENT DOCUMENTS

| | | | |
|---|---|---|---|
| 5,138,234 | 8/1992 | Moisin | 315/209 R |
| 5,220,247 | 6/1993 | Moisin | 315/209 R |
| 5,387,846 | 2/1995 | So | 315/209 R |
| 5,404,083 | 4/1995 | Nilssen | 315/244 |
| 5,436,529 | 7/1995 | Bobel | 315/127 |
| 5,500,576 | 3/1996 | Russell et al. | 315/307 |
| 5,635,799 | 6/1997 | Hesterman | 315/225 |

*Primary Examiner*—Robert Pascal
*Assistant Examiner*—Michael B. Shingleton
*Attorney, Agent, or Firm*—Gary J. Cunningham; Kenneth D. Labudda

[57] ABSTRACT

A protection method (10) and protection circuit (500) for protecting an inverter (300) in an electronic preheat ballast (100) for powering at least one fluorescent lamp (902). The inverter (300) includes a first inverter switch (306), a second inverter switch (310), an output circuit (800), and an inverter driver circuit (400) having a drive frequency. The protection circuit (500) comprises a frequency shift circuit (600), a latch circuit (700), a current source network (520), a current sensing circuit (510), and a DC supply capacitance (502). The protection method (10) includes the steps of (a) providing a filament preheat period by initially setting the drive frequency at a first frequency, (b) shifting the drive frequency to a second frequency for igniting and operating the lamps, (c) changing the drive frequency back to the first frequency in response to a lamp fault, and (d) providing, upon correction of the lamp fault, a filament preheat period prior to attempting to ignite and operate the lamps.

14 Claims, 7 Drawing Sheets

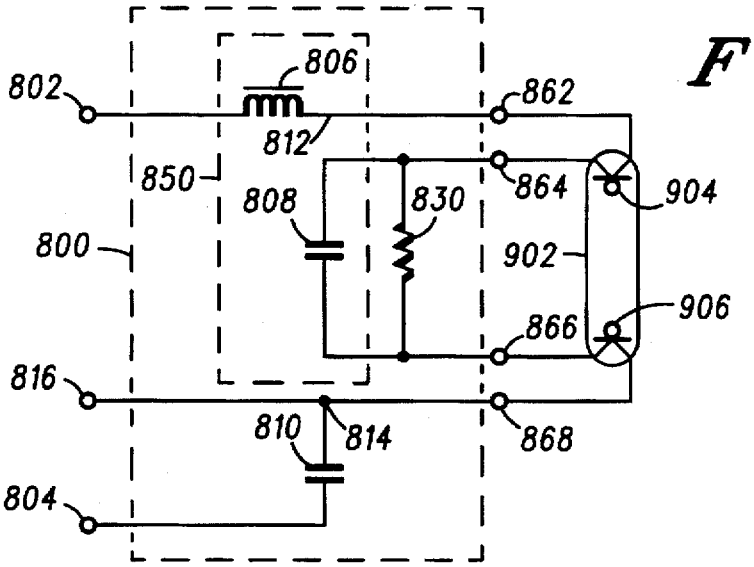
FIG. 5
FIG. 6
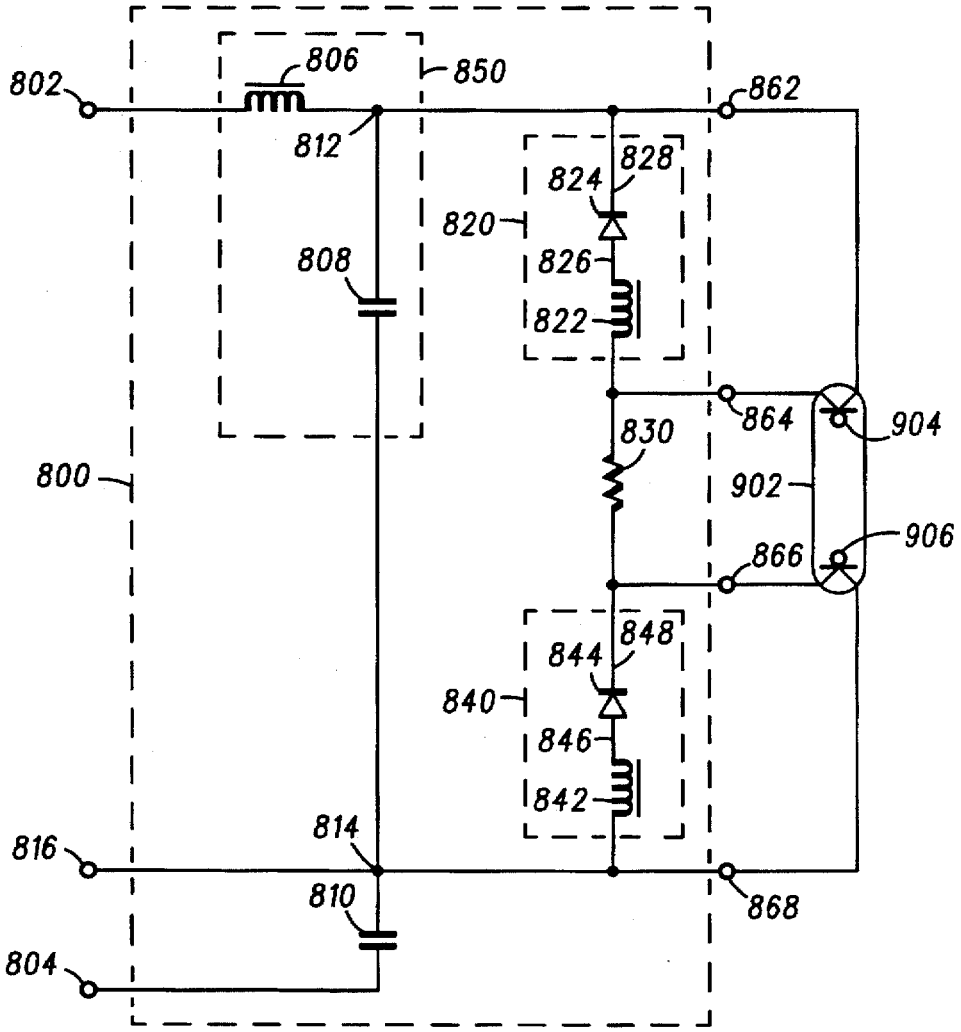

INVERTER PROTECTION METHOD AND PROTECTION CIRCUIT FOR FLUORESCENT LAMP PREHEAT BALLASTS

FIELD OF THE INVENTION

The present invention relates to the general subject of electronic ballasts and, in particular, to an inverter protection method and protection circuit for fluorescent lamp preheat ballasts.

BACKGROUND OF THE INVENTION

Electronic ballasts typically include an inverter circuit for converting a direct current (DC) voltage into a high frequency current for efficiently powering fluorescent lamps. In such inverters, a resonant circuit is commonly employed in order to provide a high voltage for igniting the lamps, as well as very efficient powering of the lamps.

At some point in its operating life, a ballast will probably encounter a lamp fault in which one or more lamps are either failed, removed, or operating abnormally. Common examples of lamp faults include lamp removal, open filaments, degassed lamp, and diode mode operation (in which the lamp conducts current in primarily one direction). It is highly desirable that the ballast not only physically survive during a lamp fault, but resume normal operation with minimal inconvenience to the user after the lamp fault is corrected and all lamps are once again operational.

Because of the extremely high voltages which tend to develop under unloaded or abnormally loaded conditions, a resonant inverter is not, by itself, well suited for long-term survival in the absence of a normally operating lamp load. Sustained occurrence of high voltages in such inverters may eventually cause the inverter to fail due to overvoltage or excessive power dissipation in the inverter components. Furthermore, in the case of ballasts with non-isolated outputs, safety considerations dictate that, in the absence of a normally operating lamp load, the inverter either be shut down or operated in manner which poses no electrocution or shock hazard to users, and particularly to those who are replacing failed lamps while power is still being applied to the ballast.

It is therefore apparent that it is highly desirable that the ballast circuit be protected from overvoltage and/or excessive power dissipation in the event of a lamp fault, and that the ballast circuit resume normal operation with minimal inconvenience to the user once the lamp fault is remedied.

A number of inverter protection circuits have been proposed in the prior art. Generally, the prior art approaches fall into one of three categories.

In a first category are those protection circuits which do not shut down or alter operation of the inverter switches in response to a lamp fault. An example of this type of protection circuit is disclosed in U.S. Pat. No. 5,138,234 issued to Moisin, in which the inverter is protected in a passive manner by means of a diode clamping circuit which limits the ballast output voltage to a predetermined level. In this approach, the inverter circuit is not turned off in response to a lamp fault, but continues to operate as before.

In a second class of protection circuits, the inverter is completely shut down in response to a lamp fault. One such approach is described in U.S. Pat. No. 5,220,247, issued to Moisin, in which the inverter completely ceases to function in the event that one or more filaments become open or are disconnected from the ballast. The disclosed circuit is a direct-coupled, non-isolated arrangement and provides effective protection for self-oscillating resonant inverters, since the inverter ceases to operate if the resonant circuit path is broken. However, this approach is not directly applicable to "driven" (as opposed to self-oscillating) inverters in which inverter switching occurs independent of whether or not the resonant circuit path is intact.

U.S. Pat. No. 5,387,846, issued to So, likewise discloses a circuit which completely shuts down the inverter in response to a lamp fault. An important drawback of So's approach is that the ballast power must be turned off and on again (i.e., "cycled") in order to start the inverter up again after a lamp fault is corrected.

Still another shutdown type approach is described in U.S. Pat. No. 5,436,529 issued to Bobel, wherein it is claimed that the disclosed protection circuit offers the advantage of "flashless" protection in that it restarts the inverter and attempts to ignite the lamps only when all lamp filaments are physically intact and properly connected to the ballast. A very important disadvantage of Bobel's circuit, however, is that, after correction of a lamp fault, the inverter starts up and almost immediately attempts to ignite the lamps without first providing a filament preheat period.

A third class of protection circuits involve altering the inverter operating frequency. In U.S. Pat. No. 5,500,576 issued to Russell et al, the protection circuit does not shut the inverter off in response to a lamp fault, but shifts the inverter operating frequency to a higher value. By shifting to a higher frequency, inverter voltages and power dissipation are significantly reduced. This protection circuit periodically shifts back to a lower frequency and attempts to ignite the lamp, regardless of whether or not the lamp is actually present. Consequently, an undesirable side effect which manifests itself in a ballast which powers multiple lamps and uses a circuit like Russell's is that the remaining "good" lamps may "flash" as a result of the periodic ignition attempts. This type of circuit is thus commonly referred to as a "flasher" type protection circuit.

U.S. Pat. No. 5,404,083 issued to Nilssen, also proposes shifting the inverter frequency higher in response to a lamp fault. The disclosed circuit periodically attempts to restart by shifting to a lower frequency for a predetermined period. Therefore, this is also a "flasher" type protection circuit. Although Nilssen claims that the disclosed circuit is capable of providing some degree of filament preheating upon lamp reinsertion, the duration of the preheat time is uncontrolled since ignition attempts occur periodically and irrespective of when the lamp is reinserted.

It is therefore apparent that a protection method and circuit which protects the inverter from overvoltage and high power dissipation in the event of lamp faults, yet provides filament heating and proper ignition of a replaced lamp without the need for cycling the input power and without the occurrence of flashing in the remaining lamps, and does so with an economy of electrical components, would constitute a considerable improvement over the prior art.

BRIEF DESCRIPTION OF THE DRAWINGS

FIG. 5 shows an inverter output circuit having a direct coupled resonant circuit, in accordance with an alternative embodiment of the present invention.

FIG. 6 is a schematic of an inverter output circuit which includes auxiliary filament heating circuitry, in accordance with a preferred embodiment of the present invention.

DETAILED DESCRIPTION OF A PREFERRED EMBODIMENT

Figure 1A:
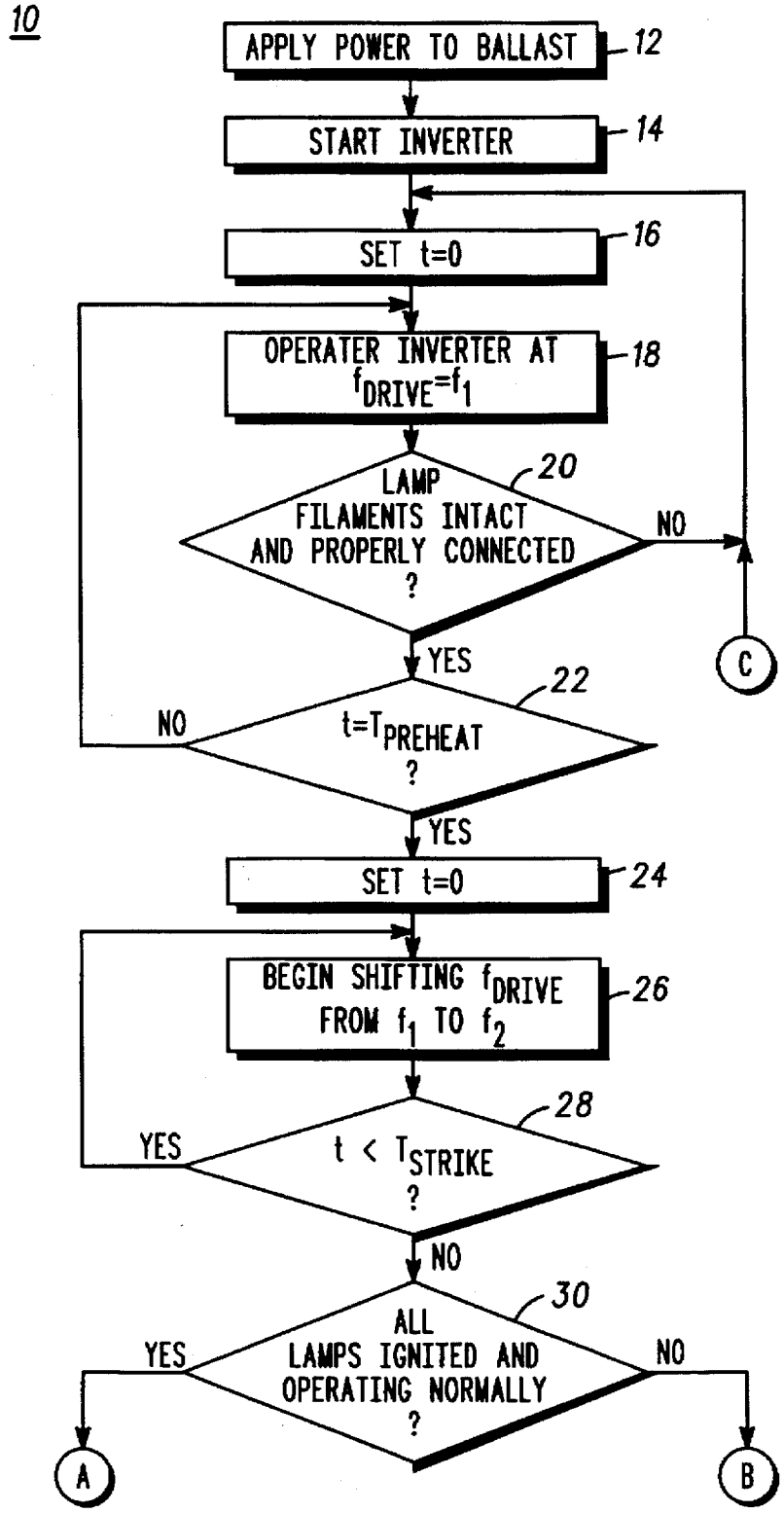
FIGS. 1A and 1B are a logic diagram which describes an inverter protection method, in accordance with the present invention.
Figure 1B:
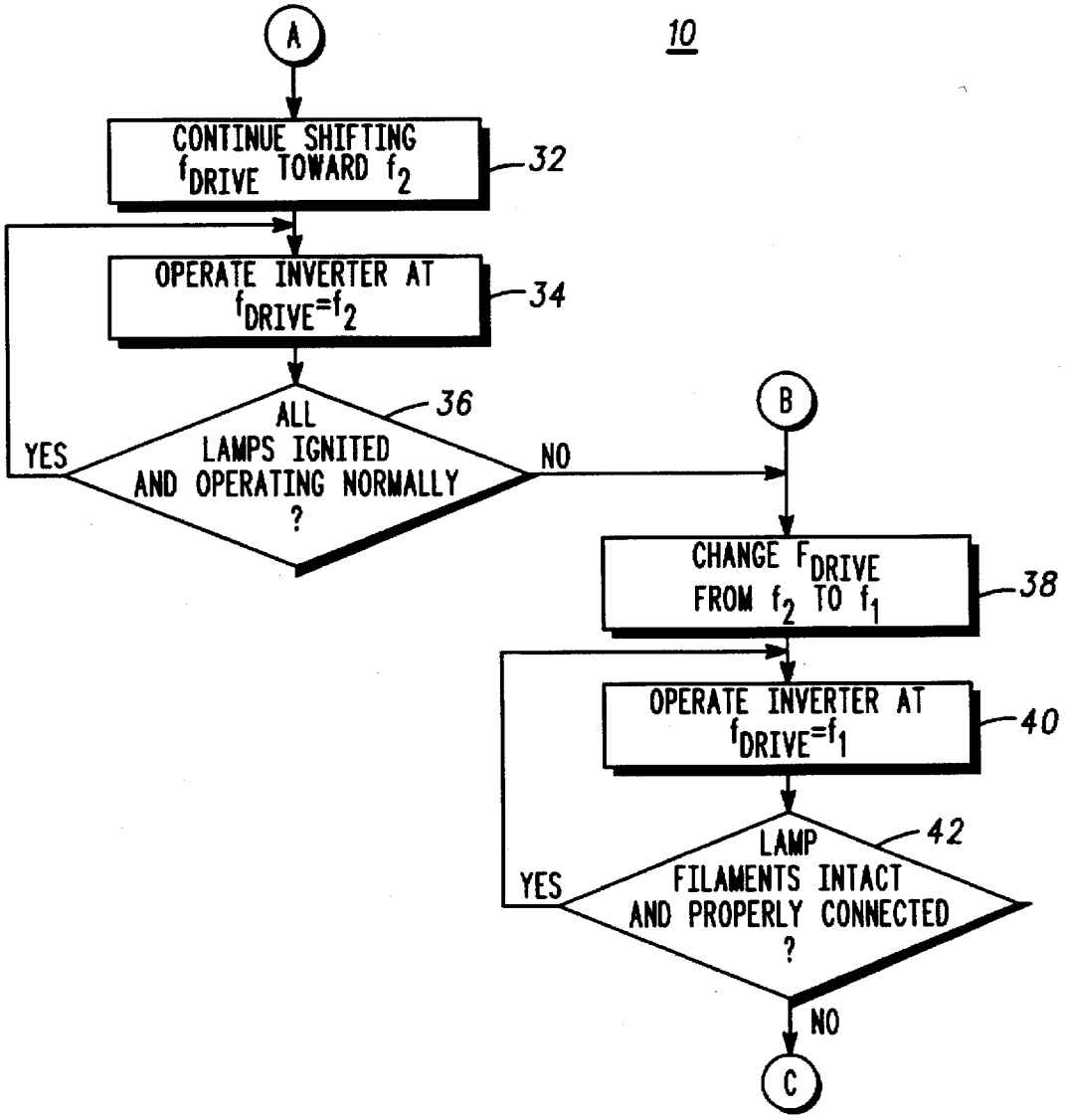

FIGS. 1A and 1B describes a method 10 for protecting a resonant inverter in an electronic preheat type ballast for powering one or more fluorescent lamps. The inverter includes a resonant circuit and an inverter driver circuit having a drive frequency. The protection method 10 includes the following steps:

(1) providing a filament preheat period in which the drive frequency remains at a first frequency for a predetermined period of time after the inverter begins to operate following application of power to the ballast;

(2) shifting the drive frequency from the first frequency to a second frequency in order to ignite and operate the lamps;

(3) changing the drive frequency from the second frequency to the first frequency in response to a lamp fault; and (4) after the lamp fault is corrected, providing a filament preheat period in which the drive frequency remains at the first frequency for a predetermined period of time prior to changing to the second frequency in order to ignite and operate the lamps.

In a preferred embodiment, the step of shifting the drive frequency from the first frequency to the second frequency is not carried out unless the lamp filaments are intact and properly connected to the ballast, and includes changing the drive frequency back to the first frequency if the lamps do not ignite within a predetermined lamp ignition period. The step of shifting the drive frequency from the first frequency to the second frequency also includes maintaining the drive frequency at the second frequency until at least such time as a lamp fault occurs. The step of changing the drive frequency from the second frequency to the first frequency is carried out if all lamps are not ignited and operating normally, and includes maintaining the drive frequency at the first frequency until at least such time as the lamp fault is corrected.

Protection method 10 is described in detail with reference to FIGS. 1A and 1B as follows. The inverter starts (step 14) after power is applied to the ballast (step 12). Once the inverter starts, a time counter is reset to t=0 (step 16), and the inverter is operated at a drive frequency, $f_{drive}$, equal to the first frequency, $f_1$ (step 18). Decision step 20 tests whether or not the lamp filaments are intact and properly connected to the ballast. If the answer is yes, the inverter will continue to operate at $f_{drive}=f_1$ until such time, $t=T_{preheat}$, as the filaments have been adequately preheated. However, if the lamp filaments are not intact or are not properly connected to the ballast, then the time counter is reset (step 16) and the inverter continues to operate at $f_{drive}=f_1$ (step 18) until at least such time as intact filaments are properly connected to the ballast (decision step 20).

If the lamp filaments are intact and properly connected to the ballast, once $t=T_{preheat}$ (step 22) the time counter is reset (step 24) and the shifting of $f_{drive}$ from the first frequency, $f_1$, to the second frequency, $f_2$, is started (step 26). It is important to recognize that the shifting of the drive frequency from $f_1$ to $f_2$ is not accomplished instantaneously but is a transition which requires a finite amount of time to complete. Prior to $f_{drive}$ actually reaching $f_2$ (step 34), the resonant circuit will develop a voltage that is high enough to ignite "good" lamps. If all lamps ignite within the predetermined lamp ignition period (i.e., prior to $t=T_{strike}$), the drive frequency will continue to be shifted (step 32) until it reaches $f_{drive}=f_2$ (step 34). On the other hand, if the lamps fail to ignite prior to $t=T_{strike}$ (steps 28, 30), it is concluded that something is wrong and the drive frequency is changed back to $f_{drive}=f_1$ (steps 38, 40).

Occurrence of a lamp fault at any time after $t=T_{strike}$ (step 36) will cause the inverter drive frequency to revert to $f_{drive}=f_1$ (steps 38, 40), where it will remain until at least such time as the lamp is removed, or at least one lamp filament either opens or is disconnected from the ballast (decision step 42), and is then replaced with an operational lamp. Upon lamp removal or disconnection of at least one lamp filament, the inverter will operate at $f_{drive}=f_1$ (step 18) and keep the time counter reset (step 16) until at least such time as the defective/failed lamp is replaced (i.e., the filaments are intact and properly connected to the ballast). Once this condition is satisfied (decision step 20), the inverter will then fully preheat the lamp filaments by continuing to operate at $f_{drive}=f_1$ (step 18) for a period of time, $T_{preheat}$, before attempting to ignite and operate the lamps by shifting $f_{drive}$ to $f_2$ (steps 26, 28, 30, 32, and 34) as previously described.

As provided for by the proposed protection method 10, the inverter will attempt to ignite the lamps only if the lamp filaments are intact and properly connected to the ballast. In addition, for lamps which are already ignited and operating properly, protection method 10 monitors the lamps and shifts the drive frequency from $f_2$ to $f_1$ in response to any lamp faults in which one or more lamps are either extinguished (e.g. degassed lamp) or depart from normal operation (e.g. diode lamp).

The disclosed protection method 10 thus provides for filament preheating not only upon initial power up of the ballast, but also following lamp replacement, and protects the inverter in the event of lamp fault conditions which might otherwise damage the inverter. Further, the proposed method 10 provides for automatic ignition and operation of replaced lamps without the need for cycling the power to the ballast and without the undesirable occurrence of flashing in the other lamps.

In one embodiment, the resonant frequency, $f_{res}$, of the inverter resonant circuit is chosen to be closer to the second frequency, $f_2$, than to the first frequency, $f_1$. Additionally, the first frequency, $f_1$, is chosen to be substantially greater than the resonant frequency, $f_{res}$. Operating the inverter at a first frequency, $f_1$, that is considerably higher than the resonant frequency, $f_{res}$, precludes premature ignition of the lamps during the filament preheating period and minimizes inverter power dissipation during lamp fault conditions. On the other hand, operating the inverter at a second frequency, $f_2$, that is fairly close to the resonant frequency, $f_{res}$, allows the resonant inverter to develop sufficient voltage for igniting the lamps and provides for efficient steady-state powering of the lamps. For the sake of illustration, a suitable choice of values in this regard might be $f_1$=50 kHz, $f_2$=34 kHz, $f_{res}$=35 kHz.

Figure 2:
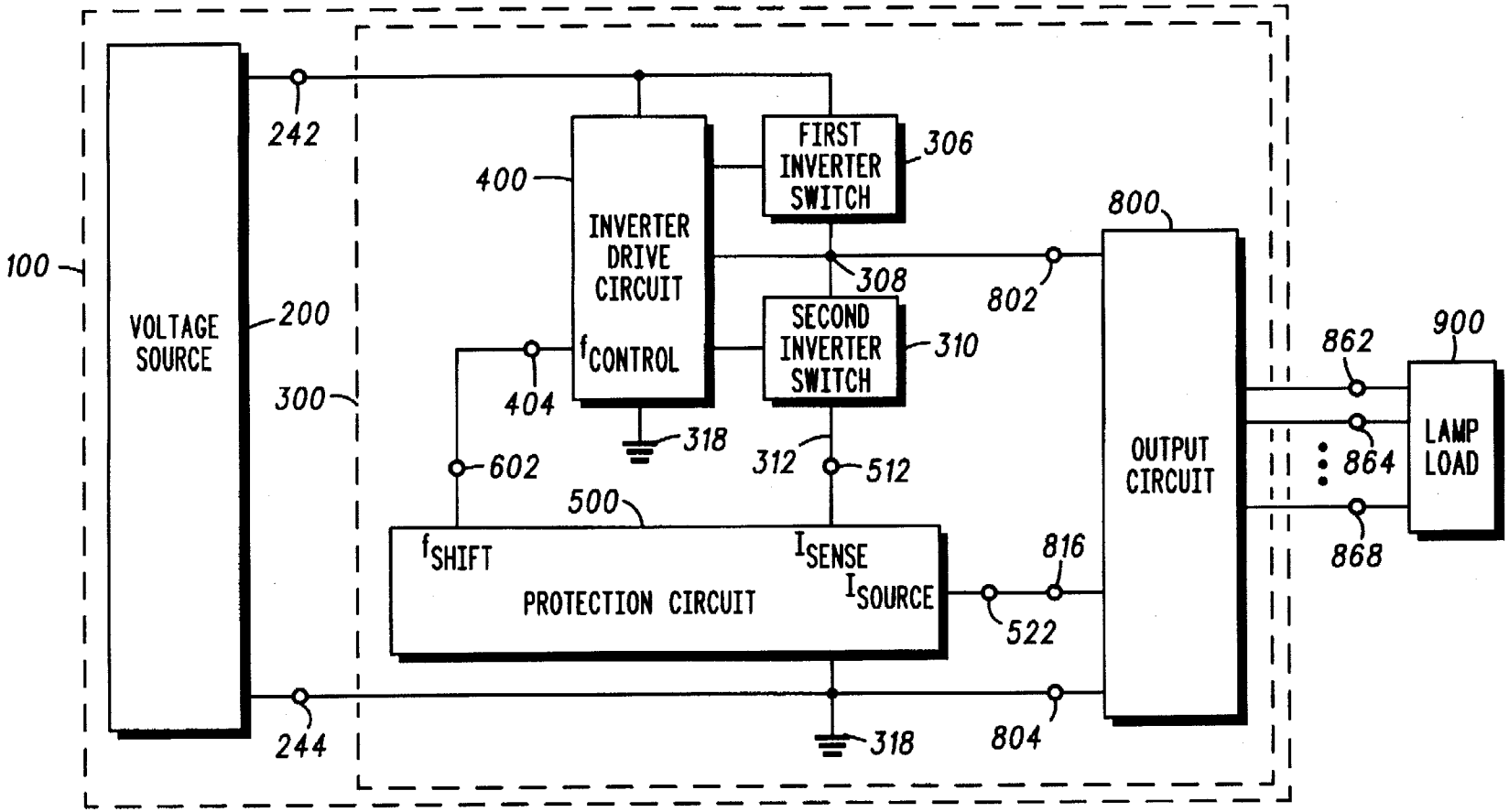
FIG. 2 describes an electronic ballast having an inverter protection circuit, in accordance with the present invention.

Referring now to FIG. 2, a block diagram of an electronic preheat type ballast 100 is shown. The ballast 100 comprises a voltage source 200 and an inverter 300. Voltage source 200 has a first output terminal 242 and a second output terminal 244, across which is provided a substantially direct current (DC) voltage. Inverter 300, which is coupled to the output terminals 242, 244 of voltage source 200, comprises a first inverter switch 306 that is coupled between the first output terminal 242 and a first node 308, a second inverter switch 310 that is coupled between the first node 308 and a second node 312, an output circuit 800, an inverter driver circuit 400, and a protection circuit 500 for protecting inverter 300 in the event of a lamp fault.

Output circuit 800 includes a first input connection 802 that is coupled to the first node 308, a second input connection 816, and a ground connection 804 that is coupled to a circuit ground node 318. Circuit ground node 318 is coupled to the second output terminal 244 of voltage source 200. Output circuit 800 also includes a plurality of output wires 862, 864, . . . , 868 that are adapted to being coupled to a lamp load 900. With momentary reference to FIG. 5, lamp load 900 includes at least one fluorescent lamp 902 having a pair of lamp filaments 904, 906.

Referring again to FIG. 2, inverter driver circuit 400 is coupled to, and provides a drive signal having a drive frequency for switching, the inverter switches 306, 308. The driver circuit 400 also includes a frequency control input 404. Internal to the inverter driver circuit 400, as shown in FIG. 3, are a frequency determining resistor 408 and a frequency determining capacitor 410, the values of which determine the drive frequency.

Figure 3:
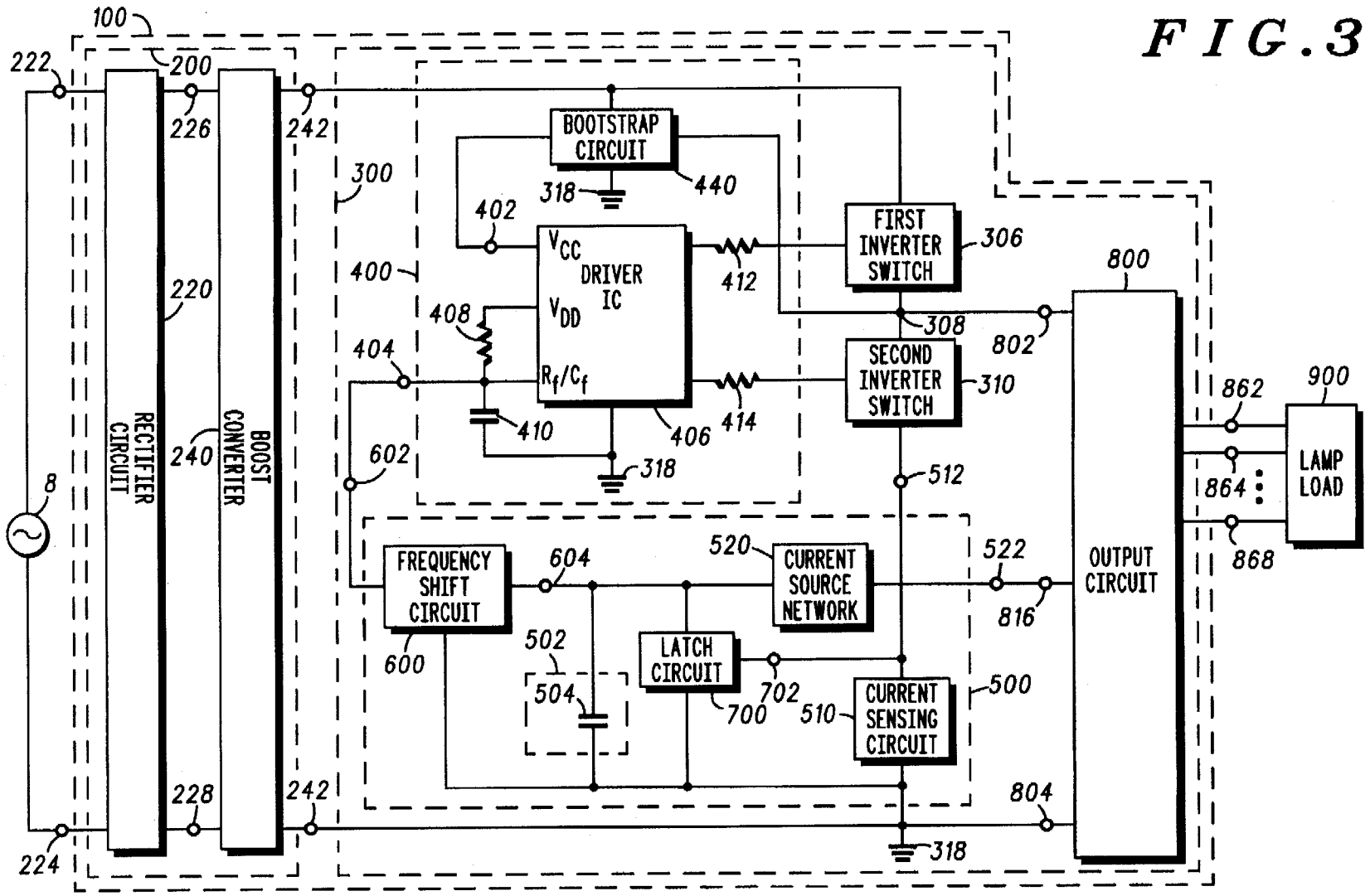
FIG. 3 is a circuit diagram of an electronic ballast which shows functional blocks of an inverter protection circuit, in accordance with the present invention.

In a preferred embodiment of ballast 100, as shown in FIG. 3, voltage source 200 comprises a rectifier circuit 220 and a boost converter 240, and inverter 300 includes a bootstrap circuit 440 for powering a driver integrated circuit (IC) 406, an example of which is the IR2151 high-side driver IC manufactured by International Rectifier. Driver IC 406 includes a power supply input 402, and drives inverter switches 306, 310 by way of drive resistors 412, 414. Rectifier circuit 220 has a pair of input wires 222, 224 that are adapted to receive a source of alternating current 8, and a pair of output wires 226, 228. Boost converter 240 is coupled to the rectifier circuit output wires 226, 228, and includes a pair of output terminals 242, 244 across which inverter 300 is coupled.

As shown in FIG. 3, protection circuit 500 comprises a frequency shift circuit 600, a latch circuit 700, a current source network 520, a current sensing circuit 510, and a DC supply capacitance 502. Frequency shift circuit 600 is operable to control the inverter drive frequency by controlling the frequency determining capacitance and/or the frequency determining resistance of the inverter driver circuit 400. Frequency shift circuit 600 includes a frequency shift output 602 and a DC supply input 604. Frequency shift output 602 is coupled to frequency control input 404, and DC supply input 604 has a DC supply voltage. The DC supply capacitance 502 comprises at least one capacitor 504 that is coupled between the DC supply input 604 and the circuit ground node 318. Current sensing circuit 510 is coupled between a current sense input 512 and the circuit ground node 318, and the current sense input 512 is coupled to the second node 312 of inverter 300. Current source network 520 is coupled between a current source input 522 and the DC supply input 604, the current source input 522 being coupled to the second input terminal 816 of output circuit 800. Finally, latch circuit 700 is coupled between the DC supply input 604 and the circuit ground node 318. Latch circuit 700 includes a latch input 702 that is coupled to the current sense input 512.

Figure 4:
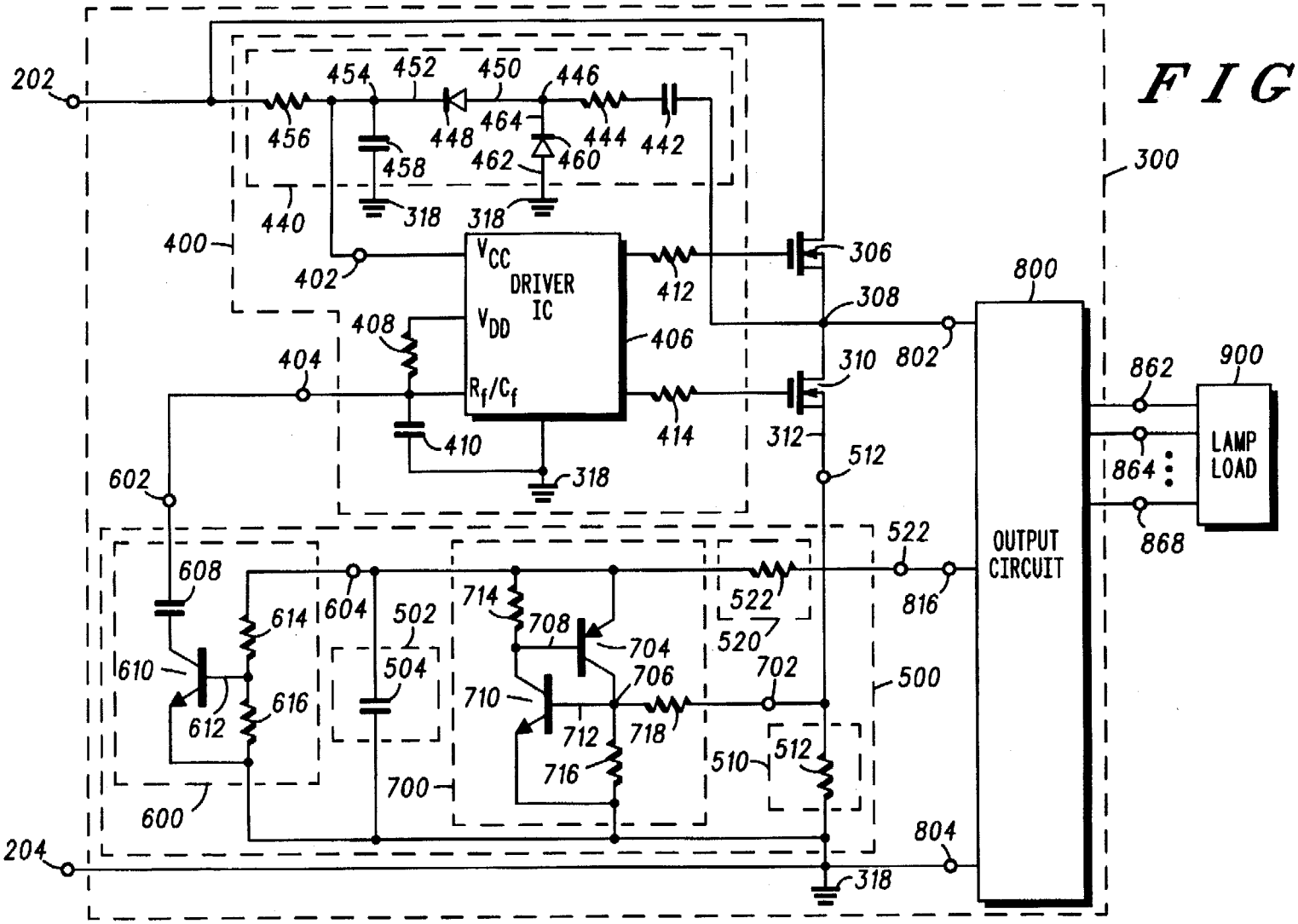
FIG. 4 is a detailed schematic of an inverter driver circuit and inverter protection circuit, in accordance with one embodiment of the present invention.

Referring now to FIG. 4, a detailed circuit diagram of a preferred embodiment of inverter protection circuit 500 and bootstrap circuit 440 is shown. In the embodiment shown in FIG. 4, protection circuit 500 controls the inverter drive frequency by controlling the frequency determining capacitance of the inverter drive circuit 400.

Frequency shift circuit 600 comprises a frequency shift capacitor 608, a frequency shift switch 610, a first resistor 614, and a second resistor 616. A series combination of capacitor 608 and switch 610 is coupled between the frequency shift output 602 and the circuit ground node 318. First resistor 614 is coupled between DC supply input 604 and a control terminal 612 of frequency shift switch 10, while second resistor 616 is coupled between control terminal 612 and circuit ground node 318.

Latch circuit 700 comprises a first latch switch 704 having a first latch control terminal 708, a second latch switch 710 having a second latch control terminal 712 that is coupled to a first latch node 706, a first latch resistor 714, a second latch resistor 716, and a latch enable resistor 718. The first latch switch 704 is coupled between the DC supply input 604 and the first latch node 706, and the second latch switch is coupled between the first latch control terminal 708 and the circuit ground node 318. The first latch resistor 714 is coupled between the DC supply input 604 and the first latch control terminal 708, the second latch resistor 716 is coupled between the first latch node 706 and the circuit ground node 318, and the latch enable resistor 718 is coupled between the first latch node 706 and the enable input 702 of the latch circuit 700.

Current source network 520 comprises a current source resistor 522 that is coupled between the current source input 522 and the DC supply input 604, and current sensing circuit 510 comprises a current sense resistor 512 that is coupled between the current sense input 512 and the circuit ground node 318.

FIG. 4 also describes a preferred embodiment of bootstrap circuit 440, which provides power for operating driver IC 406. Driver IC 406 includes a power supply input 402, and provides drive signals via drive resistors 412, 414 for alternatively switching inverter switches 306, 310. Boostrap circuit 440 comprises a series combination of a bootstrap coupling capacitor 442 and a bootstrap coupling resistor 444, a bootstrap rectifier 448, a startup resistor 456, and a bootstrap supply capacitance 458. The series combination of capacitor 442 and resistor 444 is coupled between the first node 308 and a fifth node 446. Bootstrap rectifier has an anode 450 that is coupled to the fifth node 446 and a cathode 452 that is coupled to a sixth node 454, the sixth node 454 being coupled to the power supply input 402 of the inverter driver circuit 400. Startup resistor 456, which is responsible for initial startup of inverter 300 by providing a current for initially charging up capacitor 458 to a level that is sufficient to activate driver IC 406, is coupled between the sixth node 454 and the first output terminal 202 of voltage source 200. Bootstrap supply capacitance 458 comprises at least one capacitor that is coupled between the sixth node 454 and the circuit ground node 318. Bootstrap circuit 440 also includes a reset diode 460 having an anode 462 that is coupled to the circuit ground node 318 and a cathode 464 that is coupled to the fifth node 446.

In one embodiment that is shown in FIG. 5, output circuit 800 includes a resonant circuit 850 that comprises a resonant inductor 806 and a resonant capacitor 808. Output circuit 800 also includes a DC blocking capacitor 810 and a filament path resistor 830. Resonant inductor 806 is coupled between the first input connection 802 and a third node 812, the third node 812 being coupled to a first output wire 862. Resonant capacitor 808 is coupled between a second output wire 864 and a third output wire 866. DC blocking capacitor 810 is coupled between a fourth node 814 and the ground connection 804, and filament path resistor 830 is coupled between the second and third output wires 864, 866. The first and second output wires 862, 864 are adapted to having a first lamp filament 904 coupled across them, and the third and fourth output wires 866, 868 are adapted to having a second lamp filament 906 coupled across them.

A preferred form of output circuit 800 which provides "voltage-fed" filament preheating (as opposed to the "current-fed" filament preheating provided by the output circuit of FIG. 5) is shown in FIG. 6. The output circuit 800 comprises a resonant inductor 806 that includes at least two auxiliary windings 822, 842, a resonant capacitor 808, a DC blocking capacitor 810, a filament path resistor 830, a first filament voltage source 820, and a second filament voltage source 840. Resonant inductor 806 is coupled between the first input connection 802 and a third node 812 that is coupled to a first output wire 862. Resonant capacitor 808 is coupled between the third node 812 and a fourth node 814 that is coupled to a fourth output wire 868 and the second input connection 816 of output circuit 800. DC blocking capacitor 810 is coupled between the fourth node 814 and the ground connection 804, and filament path resistor 830 is coupled between the second and third output wires 864, 866.

The first filament voltage source 820, which is coupled across the first and second output Wires 862, 864, comprises a first auxiliary winding 822 of resonant inductor 806 and a first diode 824. Specifically, the first auxiliary winding 822 is coupled between the second output wire 864 and an anode 826 of first diode 824, while a cathode 828 of diode 824 is coupled to the first output wire 862. In similar fashion, second filament voltage source 840 is coupled across the third and fourth output wires 866, 868, and includes a second auxiliary winding 842 of resonant inductor 806 and a second diode 844. The second auxiliary winding 842 is coupled between the fourth output wire 868 and an anode 846 of diode 844, while a cathode 848 of diode 844 is coupled to the third output wire 866.

Figure 7:
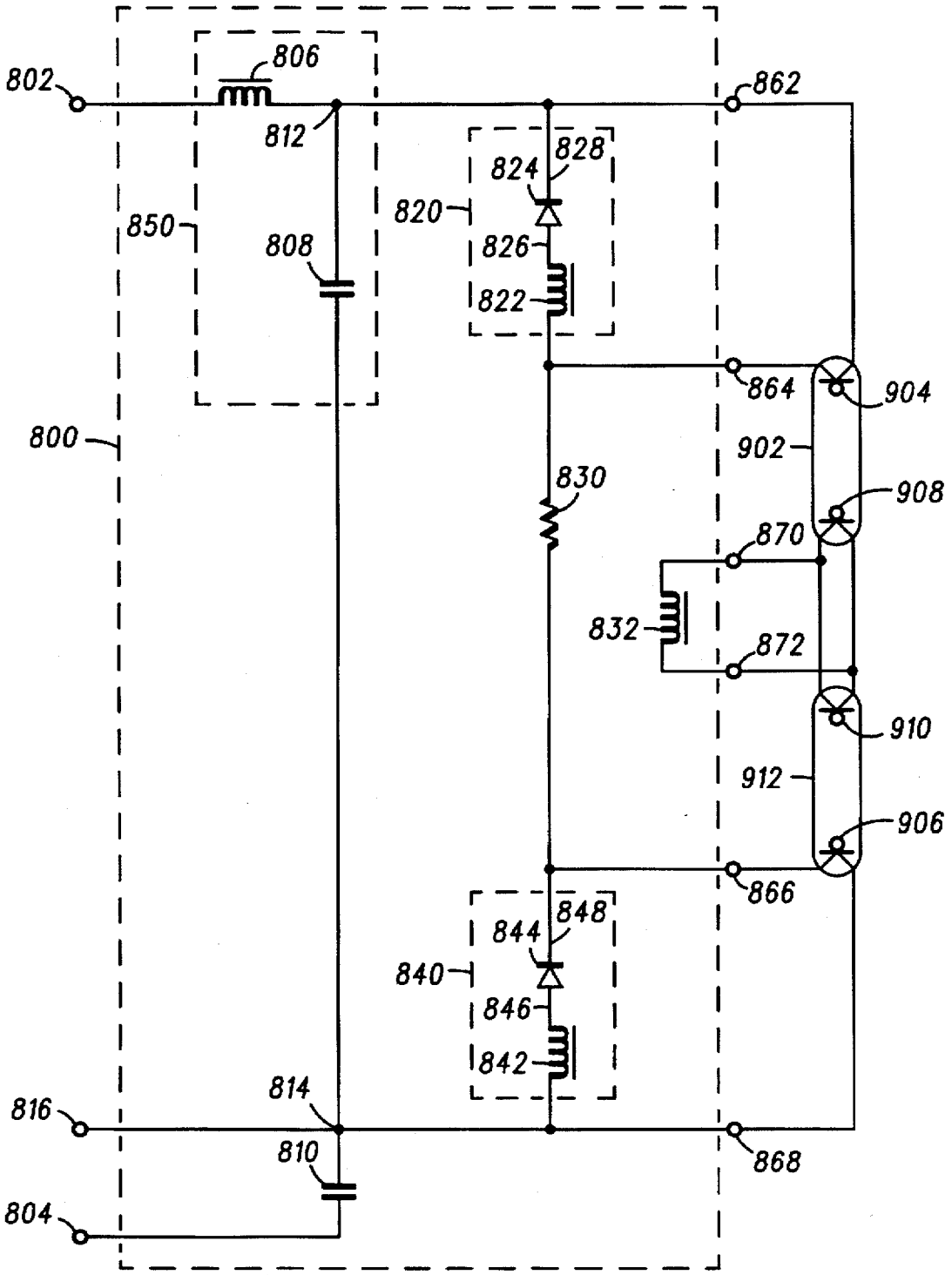
FIG. 7 shows a modified version of the inverter output circuit of FIG. 6 that is applicable to a ballast for powering multiple fluorescent lamps, in accordance with the present invention.

The output circuit of FIG. 6 can be adapted to provide power to multiple lamps by including additional auxiliary windings on resonant inductor 806. An example of this is shown in FIG. 7, in which two lamps 904, 912 are accommodated by including a third auxiliary winding 832 on resonant inductor 806, as well as two additional output wires 870, 872 for providing voltage to filaments 908, 910.

In the circuit shown in FIG. 4, the inverter drive frequency, $f_{drive}$, is substantially inversely proportional to the arithmetical product of the frequency determining resistor 408, and an effective frequency determining capacitance. Any increase in the effective frequency determining capacitance, $C_{eff}$, has the effect of lowering $f_{drive}$, and any increase in $C_{eff}$ has the effect of increasing $f_{drive}$. The effective frequency determining capacitance, $C_{eff}$, can take on one of two values, depending upon whether or not frequency shift switch 610 is on. Specifically, with switch 610 open, $C_{eff}$ is equal to the capacitance of capacitor 410, Cf, and $f_{drive}$ is at a relatively high value, f1. When switch 610 is closed, on the other hand, capacitor 608, having a value of $C_{shift}$, is placed in parallel with capacitor 410, and $C_{eff}$ is increased from $C_f$ to $C_f+C_{shift}$, the result being that the drive frequency, $f_{drive}$, correspondingly decreases from $f_1$ to $f_2$.

Frequency shift circuit 600 is operable to turn the frequency shift switch 610 on when the DC supply voltage at DC supply input 604 reaches or exceeding a predetermined supply voltage threshold value, $V_{shift}$. Specifically, when a bipolar junction transistor (BJT) is used for switch 610, switch 610 will turn on when the voltage at control terminal 612 equals or exceeds approximately 0.7 volts, which is the base-to-emitter voltage that is typically needed in order to forward bias a BJT. Switch 610 will remain on, and $f_{drive}$ will remain at $f_2$, as long as the DC supply voltage that is present at DC supply input 604 equals or exceeds $V_{shift}$.

Referring again to FIG. 4, the operation of latch circuit 700 is summarized as follows. Latch switch 710 turns on in response to the latch voltage at latch input 702 exceeding a latch threshold value, $V_{latch}$. Once latch switch 710 turns on, the control terminal 708 of the second latch switch 704 is effectively coupled to circuit ground node 318. Consequently, switch 704 will also turn on. Once turned on, latch switches 704, 710 will remain on even if the voltage at latch input 702 drops below $V_{latch}$, but only as long as the voltage at the DC supply input remains greater than the approximately 0.7 volts that is needed in order to keep switch 704 forward-biased. Therefore, the latch 700 will remain on, once turned on, as long as sufficient holding current is available. As will be explained in greater detail below with reference to FIG. 6, sufficient holding current is provided to latch 700 via current source network 520 as long as a filament path is intact.

Referring again to FIG. 4, the operation of bootstrap circuit 440 is detailed as follows. Initially, upon application of power to ballast 100, inverter 300 is off and does not begin to operate until driver circuit 400 turns on and begins to switch inverter switches 306, 308. Following application of power to ballast 100, a substantially DC voltage will be present across the voltage source output terminals 202, 204. Consequently, a DC current will flow through resistor 440 and begin to charge up capacitor 458. As is characteristic of many such circuits, driver IC 400 is inhibited from operating until such time as the voltage at power supply input 402 reaches a predetermined startup threshold value, $V_{start}$. As soon as the voltage across capacitor 458 reaches $V_{start}$, driver IC 406 turns on and begins switching of inverter switches 306, 308. Consequently, the voltage at node 308, $V_x$, assumes its steady-state operating waveshape of an offset squarewave having a positive half cycle, $V_x=+V_1$, and an approximately zero valued half cycle, $V_x=0$. At this point, the energy required to keep driver IC 406 operating begins to be provided by operation of the inverter itself.

During the positive half cycles of $V_x$, bootstrap rectifier 448 is forward biased and delivers charging current to capacitor 458, which provides filtering so that the voltage provided at power supply input 402 is substantially DC. Coupling capacitor 442 is present to prevent abnormal or undesirable inverter operation by limiting the otherwise significant "loading effect" presented by bootstrap circuit 440. Coupling resistor 444 serves to limit the peak value of the current which flows through capacitor 442 at the beginning of each positive half cycle of $V_x$. It is important to note that, early on in each positive half cycle of $V_x$, capacitor 442 develops a large DC voltage (i.e., capacitor 442 will become peak charged at $+V_1$) which, if not discharged at some point prior to the next positive half cycle of $V_x$, will prevent any further current from flowing through capacitor 442 for replenishing capacitor 458. The end result would be that bootstrap circuit 440 would cease to function, as would inverter driver IC 406 and inverter 300 shortly thereafter. Reset diode 460 prevents this problem from occurring by providing a discharge path for removing, during each zero half cycle of $V_x$, the positive voltage stored across capacitor 442 during the preceding positive half cycle of $V_x$.

The detailed operation of inverter 300 and protection circuit 500 is now explained with reference to FIGS. 4 and 6 as follows. As discussed previously, FIG. 6 describes an output circuit 800 in which "voltage-fed" filament heating is provided by way of filament heating circuits 820, 840. As long as inverter 300 is operating, an AC voltage will develop across resonant inductor 806 and auxiliary windings 822, 842, which are secondary windings of resonant inductor 806, will supply current for heating their respective lamp filaments 904, 906.

Referring again to FIG. 6, when lamp 902 is properly connected to the ballast and filaments 904, 906 are both intact, a DC current path exists. In this DC current path, hereinafter referred to as "the filament path," a DC current flows from input connection 802, through resonant inductor 806, node 812, output wire 862, first filament 904, output wire 864, filament path resistor 830, output wire 866, second filament 906, output wire 868, and to node 814. At node 814, the filament path current splits into two parts, the first of which goes into DC blocking capacitor 810 and the second of which is delivered to protection circuit 500 via output circuit terminal 816 and current source input 522 (see FIG. 4). It is this second part of the filament path current which is responsible for operation of protection circuit 500, since it provides the current for charging up DC supply capacitance 502 so as to activate the frequency shift circuit 610, and also provides the holding current needed to keep latch circuit 700 on after it has been turned on. Importantly, if one or both lamp filaments are open or are disconnected from their respective output wires, the filament path no longer exists, and therefore cannot supply DC current to protection circuit 500. Note that diodes 824, 844 are included in filament voltage sources 820, 840 in order to prevent the supply of DC current to protection circuit 500 when the filament path is open.

Referring to FIGS. 4 and 6, the sequence of events is as follows when an operational lamp 902 with intact filaments 904, 906 is properly connected to the ballast 100. Following application of power to ballast 100, inverter driver circuit 400 will start up and begin driving the inverter switches 306, 308 at a first frequency, $f_1$. At this point, with frequency shift switch 610 off, the effective frequency determining capacitance, $C_{eff}$, is equal to the capacitance, $C_f$, of capacitor 410.

With the inverter operating at $f_{drive}=f_1$, there is insufficient voltage across the output wires to ignite lamp 902. However, filament voltage sources 820, 840 each supply current for heating lamp filaments 904, 906. With the first and second filaments 904, 906 intact and properly connected to the ballast, a DC current flows in the filament path as previously described. This DC current flows into current source input 522, through current source resistor 522, and begins to charge DC supply capacitor 504. After a predetermined preheat period, $T_{preheat}$, the duration of which is controlled by the resistances of resistors 830, 522 and the capacitance of capacitor 504, the voltage across capacitor 504 reaches the predetermined DC supply voltage threshold, $V_{shift}$, at which time frequency shift switch 610 turns on and effectively places capacitor 608 in parallel with capacitor 410. Consequently, $C_{eff}$ is increased from its previous value of $C_f$ to $C_f+C_{shift}$, which causes $f_{drive}$ to decrease from $f_1$ to $f_2$. Again, it is important to realize that the shifting of $f_{drive}$ from $f_1$ to $f_2$ is not accomplished instantaneously, but takes a finite amount of time to complete, during which time $f_{drive}$ is decreasing.

At some point prior to $t=T_{strike}$ ($t=0$ being defined as the time at which frequency shift switch 610 is turned on and $f_{drive}$ begins to decrease from $f_1$), sufficient voltage will develop across the output wires to ignite lamp 902. With lamp 902 ignited, current continues to flow into capacitor 504, so switch 610 remains on and maintains $f_{drive}=f_2$ as long as the lamp continues to operate normally.

If, at some future time, the lamp either completely fails to conduct (e.g. degassed lamp) or begins to operate in an erratic or asymmetric fashion (e.g. diode lamp), the current flowing through the inverter switches 306, 310 will increase significantly. This increase in the switch current will translate into a voltage across current sense resistor 512 that exceeds the predetermined current sense threshold voltage, $V_{latch}$, that is needed to turn on latch circuit 700. Therefore, latch circuit 700 will turn on and shunt the DC supply input 604 to the circuit ground node 318, thereby rapidly discharging capacitor 504. Once capacitor 504 discharges to a voltage that is less than the frequency shift threshold value, $V_{shift}$, frequency shift switch 610 will turn off and $f_{drive}$ will increase from $f_2$ to $f_1$. Capacitor 504 will be further discharged and prevented from charging up again as long as latch circuit 700 is on.

Once $f_{drive}$ is changed to $f_1$, the inverter switch current will decrease and the voltage across current sense resistor 512 will drop below $V_{latch}$. However, latch 700 will remain on due to the holding current which is supplied as long as both lamp filaments 904, 906 are intact.

At this point, with a failed lamp having intact filaments that are still properly connected to the ballast, $f_{drive}$ will remain at $f_2$ unless the lamp 902 is disconnected from the ballast 100 or at least one of the lamp filaments 904, 906 becomes open. If the lamp 902 is disconnected or at least one filament 904, 906 opens, the filament path will no longer be intact. Consequently, the latch 700 will lack the holding current needed to remain on, and will turn off (or, to use a better term, reset). In addition, with the filament path opened, DC supply capacitor 504 will be deprived of the current needed in order to charge up and reach the value, $V_{shift}$, for activating frequency shift circuit 600.

If the failed lamp is removed and then replaced with a good lamp having intact filaments, the filament path will be reestablished and a charging current will once more be provided to capacitor 504. After a predetermined preheat period, $T_{preheat}$, the DC supply voltage will reach $V_{shift}$, $f_{drive}$ will begin to decrease, the lamp will be ignited, and $f_{drive}$ will continue to decrease until it reaches $f_{drive}=f_2$, where it will remain as long as the lamp continues to operate normally. In this way, protection circuit 500 and output circuit 800 function together to provide full filament preheating prior to attempting to ignite a replaced lamp.

It is worth noting that, if one or both filaments suddenly "blow" while a lamp is operating, the protection circuit 500 provides for continued operation of the lamp as long as the lamp is not extinguished and the blown filament condition is not accompanied by additional lamp faults, such as diode lamp operation. This is a consequence of the fact that, as long as the lamp is operating normally, DC blocking capacitor 810 will have large enough a voltage across it to provide the current needed to replenish capacitor 504 and thereby keep frequency shift switch 610 on, even though the filament path is open and contributes no current. At the same time, however, it should also be recognized that the protection circuit 500 will prevent the inverter from attempting to ignite such a lamp the next time that power is applied to the ballast. This is so because in order to initially activate frequency shift circuit 600 and shift $f_{drive}$ from $f_1$ to $f_2$, the filament path must be intact, which it cannot be if the lamp 902 does not have both filaments 904, 906 intact.

In the case of a lamp having intact filaments, but which is incapable of igniting, such as a degassed lamp, the inverter 300 will be protected as follows. As recited previously, following application of power to ballast 100, inverter driver circuit 400 will start up and begin driving the inverter switches 306, 308 at the first frequency, $f_1$. Upon completion of the preheat period, $T_{preheat}$, frequency shift circuit 600 will turn on and begin the action of shifting $f_{drive}$ from $f_1$ to $f_2$. As $f_{drive}$ decreases and thus becomes closer to fres, the voltage across the output wires will increase and eventually reach a value that is large enough to ignite lamp 902 if the lamp is good. If the lamp does not ignite prior to $t=T_{strike}$, the current flowing through inverter switch 310 will continue to rise and will eventually attempt to exceed the current sense threshold value. In response, latch 700 will turn on and rapidly discharge capacitor 504. Consequently, frequency shift switch 610 will turn off and $f_{drive}$ will revert back to $f_1$, where it will remain until at least such time as lamp 902 is replaced.

It can therefore be seen that protection circuit 500 avoids periodic restart attempts (which, as mentioned previously, produces flashing in a ballast with multiple lamps) by waiting for the defective lamp to be removed and then replaced with another lamp before again attempting lamp ignition, yet provides ignition of the replaced lamp without requiring cycling of the ballast power.

Inverter protection method 10 and protection circuit 500 thus provide a combination of operational features which render the present invention markedly advantageous over existing approaches. First of all, method 10 and circuit 500 protect the inverter from many types of lamp faults, including those faults, such as degassed and diode mode lamps, in which the lamp filaments are still intact. Secondly, by controllably shifting the inverter drive frequency, the disclosed invention adequately protects the inverter from overvoltage failure and high power dissipation, and provides filament preheating without the need for extensive additional preheat circuitry. A third benefit is the feature of "flashless" protection, which follows from the fact that lamp ignition is not even attempted unless all lamp filaments are intact and all lamps are properly connected to the ballast. A fourth benefit of the proposed invention is that it is highly user-convenient since it does not require cycling of the ballast input power in order to resume normal operation after a lamp fault is corrected. Fifth, the present invention greatly improve upon existing approaches by providing full filament preheating not only following initial application of power to the ballast, but also after a lamp fault is corrected. Finally, the proposed protection ballast 100 achieves the aforementioned functional benefits using a relatively small number of electrical components.

Although the present invention has been described with reference to certain preferred embodiments, numerous modifications and variations can be made by those skilled in the art without departing from the novel spirit and scope of this invention.

What is claimed is:

1. An electronic preheat type ballast comprising:

a voltage source having a first output terminal and a second output terminal, the voltage source providing a substantially DC voltage between the first and second output terminals; and an inverter that is coupled to the output terminals of the voltage source, the inverter comprising:

a first inverter switch that is coupled between the first output terminal of the voltage source and a first node, and a second inverter switch that is coupled between the first node and a second node;

an output circuit comprising:

a first input connection that is coupled to the first node;

a second input connection;

a ground connection that is coupled to a circuit ground node, the circuit ground node being coupled to the second output terminal of the voltage source;

a resonant circuit having a resonant frequency; and a plurality of output wires that are adapted to being coupled to a lamp load that includes at least one fluorescent lamp having a pair of lamp filaments;

an inverter driver circuit that is coupled to the first and second inverter switches and that is operable to provide a drive signal for switching the inverter switches, the drive signal having a drive frequency, the driver circuit including a frequency control input, a frequency determining resistance, and a frequency determining capacitance; and a protection circuit for protecting the inverter in the event of a lamp fault, the protection circuit comprising:

a frequency shift circuit having a frequency shift output and a DC supply input, the frequency shift output being coupled to the frequency control input of the inverter driver circuit, the DC supply input having a DC supply voltage, the frequency shift circuit being operable to control the inverter drive frequency by controlling at least one of the frequency determining capacitance and the frequency determining resistance;

a DC supply capacitance comprising at least one capacitor that is coupled between the DC supply input and the circuit ground node; and a current sensing circuit that is coupled between a current sense input and the circuit ground node, the current sense input being coupled to the second node of the inverter;

a current source network that is coupled between a current source input and the DC supply input of the frequency shift circuit, the current source input being coupled to the second input terminal of the output circuit; and a latch circuit that is coupled between the DC supply input and the circuit ground node, the latch circuit including a latch input that is coupled to the current sense input.

2. The electronic ballast of claim 1, wherein the frequency shift circuit comprises:

a series combination of a frequency shift capacitor and a frequency shift switch that is coupled between the frequency shift output and the circuit ground node, the frequency shift switch including a control terminal;

a first resistor that is coupled between the DC supply input and the control terminal of the frequency shift switch; and a second resistor that is coupled between the control terminal of the frequency shift switch and the circuit ground node; and the frequency shift circuit being operable to turn the frequency shift switch on and increase the frequency determining capacitance of the inverter driver circuit in response to the DC supply voltage reaching or exceeding a predetermined supply voltage threshold value.

3. The electronic ballast of claim 1, wherein the latch circuit comprises:

a first latch switch that is coupled between the DC supply input and a first latch node, the first latch switch having a first latch control terminal;

a second latch switch that is coupled between the first latch control terminal and the circuit ground node, the second latch switch having a second latch control terminal that is coupled to the first latch node;

a first latch resistor that is coupled between the DC supply input and the first latch control terminal;

a second latch resistor that is coupled between the first latch node and the circuit ground node; and a latch enable resistor that is coupled between the first latch node and the latch input of the latch circuit.

4. The electronic ballast of claim 1, wherein the current source network comprises a current source resistor that is coupled between the current source input and the DC supply input of the frequency shift circuit.

5. The electronic ballast of claim 1, wherein the current sensing circuit comprises a current sense resistor that is coupled between the current sense input and the circuit ground node.

6. The electronic ballast of claim 1, wherein the output circuit comprises:

a resonant inductor that is coupled between the first input connection of the output circuit and a third node, the third node being coupled to a first output wire;

a resonant capacitor that is coupled between a second output wire and a third output wire;

a DC blocking capacitor that is coupled between a fourth node and the ground connection of the output circuit, the fourth node being coupled to a fourth output wire and the second input connection of the output circuit;

a filament path resistor that is coupled between the second and third output wires;

the first and second output wires being adapted to having a first lamp filament coupled across them;

the third and fourth output wires being adapted to having a second lamp filament coupled across them.

7. The electronic ballast of claim 1, wherein the output circuit comprises:

a resonant inductor that is coupled between the first input connection and a third node, the third node being coupled to a first output wire, the resonant inductor including at least two auxiliary windings;

a resonant capacitor that is coupled between the third node and a fourth node, the fourth node being coupled to a fourth output wire and the second input connection of the output circuit;

a DC blocking capacitor that is coupled between the fourth node and the ground connection;

a filament path resistor that is coupled between a second output wire and a third output wire;

the first and second output wires being adapted to having a first lamp filament coupled across them;

the third and fourth output wires being adapted to having a second lamp filament coupled across them.

a first filament voltage source that is coupled across the first and second output wires, the first filament voltage source comprising a first auxiliary winding and a first diode, wherein the first auxiliary winding is coupled between the second output wire and an anode of the first diode, and a cathode of the first diode is coupled to the first output wire; and a second filament voltage source that is coupled across the third and fourth output wires, the second filament voltage source comprising a second auxiliary winding and a second diode, wherein the second auxiliary winding is coupled between the fourth output wire and an anode of the second diode, and a cathode of the second diode is coupled to the third output wire.

8. The electronic ballast of claim 1, wherein the inverter driver circuit further comprises a bootstrap circuit for providing power to a driver IC, the bootstrap circuit comprising:

a series combination of a bootstrap coupling capacitor and a bootstrap coupling resistor that is coupled between the first node and a fifth node;

a reset diode having an anode that is coupled to the circuit ground node and a cathode that is coupled to the fifth node;

a bootstrap rectifier having an anode that is coupled to the fifth node and a cathode that is coupled to a sixth node, the sixth node being coupled to a power supply input of the driver IC;

a startup resistor that is coupled between the sixth node and the first output terminal of the voltage source; and a bootstrap supply capacitance comprising at least one capacitor that is coupled between the sixth node and the circuit ground node.

9. The electronic ballast of claim 1, wherein the DC voltage source comprises:

a rectifier circuit having a pair of input wires that are adapted to receive a source of alternating current, and a pair of output wires; and a boost converter that is coupled to the rectifier circuit output wires, the boost converter having a pair of output terminals.

10. An electronic preheat type ballast comprising:

a voltage source having a first output terminal and a second output terminal, the voltage source providing a substantially DC voltage across the output terminals; and an inverter that is coupled to the voltage source output terminals, the inverter comprising:

a first inverter switch that is coupled between a first output terminal of the voltage source and a first node, and a second inverter switch that is coupled between the first node and a second node;

an output circuit that is coupled between the first node and a fourth node, the output circuit including a resonant circuit having a resonant frequency, and a plurality of output wires that are adapted to being coupled to a lamp load that includes at least one fluorescent lamp, the lamp load having a first lamp filament that is coupled between a first and a second output wire, and a second lamp filament that is coupled between a third and a fourth output wire;

a DC blocking capacitor that is coupled between the fourth node and a circuit ground node, the circuit ground node being coupled to the second output terminal of the voltage source;

an inverter driver circuit that is coupled to the first and second inverter switches and that is operable to provide a drive signal for switching the inverter switches, the drive signal having a drive frequency, the driver circuit including a frequency control input, a frequency determining resistance, and a frequency determining capacitance; and a protection circuit for protecting the inverter in the event of a lamp fault, the protection circuit comprising:

a frequency shift circuit having a frequency shift output and a DC supply input, the frequency shift output being coupled to the frequency control input of the inverter driver circuit, the DC supply input having a DC supply voltage, the frequency shift circuit being operable to control the inverter drive frequency by controlling at least one of the frequency determining capacitance and the frequency determining resistance;

a DC supply capacitance comprising at least one capacitor that is coupled between the DC supply input and the circuit ground node;

a current sensing circuit comprising a current sense resistor that is coupled between a current sense input and the circuit ground node, the current sense input having a current sense voltage, the current sense input being coupled to the second node of the inverter;

a current source network comprising a current source resistor that is coupled between a current source input and the DC supply input of the frequency shift circuit, the current source input being coupled to the fourth node; and a latch circuit that is coupled between the supply input and the circuit ground node, the latch circuit including a latch input that is coupled to the current sense input, the latch circuit being operable to turn on in response to a lamp fault condition and remain on as long as the lamp fault condition persists.

11. The electronic ballast of claim 10, wherein the frequency shift circuit is operable to turn on and decrease the inverter drive frequency from the first frequency to a second frequency when the DC supply voltage reaches a predetermined supply voltage threshold value.

12. The electronic ballast of claim 11, wherein the current source network supplies a charging current for charging up the DC supply capacitance as long as the first and second lamp filaments are intact and are properly connected to the ballast.

13. The electronic ballast of claim 12, wherein the latch circuit is further operable to turn off the frequency shift circuit by coupling the DC supply input to the circuit ground node in response to the current sense voltage exceeding a predetermined current sense threshold value.

14. The electronic ballast of claim 13, wherein the latch circuit is further operable to:

turn on if the current sense voltage exceeds the predetermined current sense threshold and if the first and second lamp filaments are intact and properly connected to the ballast;

remain turned on, once turned on, as long as the first and second lamp filaments are intact and are properly connected to the ballast;

turn off if at least one of the first lamp filament and the second lamp filament is not intact;

turn off if at least one of the first lamp filament and the second lamp filament is not properly connected to the ballast;

remain turned off, once turned off, as long as the current sense voltage is less than the predetermined current sense threshold value;

remain turned off, once turned off, as long as at least one of the first lamp filament and the second lamp filament is not intact; and remain turned off, once turned off, as long as at least one of the first lamp filament and the second lamp filament is not properly connected to the ballast.

* * * * *